United States Patent [19]

Uenoyama et al.

[11] Patent Number: 4,663,096

[45] Date of Patent: May 5, 1987

[54] APPARATUS AND METHOD OF HEATING MELT SPINNING HEAD STRUCTURE

[75] Inventors: Yoshio Uenoyama; Kiyoshi Takazawa, both of Saitama, Japan

[73] Assignee: Toa Nenryo Kogyo, K.K., Tokyo, Japan

[21] Appl. No.: 789,984

[22] Filed: Oct. 22, 1985

Related U.S. Application Data

[63] Continuation-in-part of Ser. No. 592,305, Mar. 22, 1984, abandoned.

[30] Foreign Application Priority Data

Mar. 22, 1983 [JP] Japan ..... 58-45867

[51] Int. Cl.[4] ..... D01F 9/12

[52] U.S. Cl. ..... 264/40.6; 264/176 F; 264/176.1; 425/144; 425/378 S; 425/379 S

[58] Field of Search ..... 264/29.2, 40.6, 176 F, 264/290.5; 425/725, 143, 144, 196, 198, 378 R, 378 S, 379 R, 379 S, 382.2

[56] References Cited

U.S. PATENT DOCUMENTS

| | | | |
|---|---|---|---|
| 2,437,686 | 3/1948 | Dreyfus | 264/176 F |
| 2,437,687 | 3/1948 | Dreyfus | 264/176 F |
| 3,347,959 | 10/1967 | Engelke et al. | 264/176 F |
| 3,957,936 | 5/1976 | Lauchenauer | 264/290.5 |
| 4,204,828 | 5/1980 | Peckinpaugh et al. | 425/72 S |
| 4,225,299 | 9/1980 | Roberts | 425/72 S |

*Primary Examiner*—Jay H. Woo
*Assistant Examiner*—J. Fortenberry
*Attorney, Agent, or Firm*—Frank J. Jordan; C. Bruce Hamburg; Manabu Kanesaka

[57] ABSTRACT

A melt spinning head structure is heated by use of a low melting point fusible alloy, preferably a binary-quaternary eutectic composition.

8 Claims, 4 Drawing Figures

APPARATUS AND METHOD OF HEATING MELT SPINNING HEAD STRUCTURE

This application is a continuation-in-part of U.S. patent application Ser. No. 592,305 Filed Mar. 22, 1984 now abandoned.

The present invention relates to apparatus and method for heating a melt spinning head structure, and more particularly, to an apparatus and method of heating a melt spinning head structure which is most suitably employed in spinning pitch carbon fibers.

Hitherto, in high-temperature melt spinning, particularly in the spinning of pitch carbon fibers, it is necessary to uniformly heat and keep at a temperature above 300° C., a melt spinning head structure consisting of an extruder, gear pump, spinneret plate and so forth. For this purpose, various methods have been proposed. The first of the methods is such that an electric heater is mounted around a spinning nozzle head to heat the melt spinning head structure. However, for example, when the spinning nozzles and the melt spinning head structure are made more complicated and increased in size in order to spin pitch into multifilaments of 500 to 1000 filaments, it becomes impossible to uniformly heat the melt spinning head structure by this method, so that uneven spinning may occur.

In order to improve the heat transfer from the electric heater to the melt spinning head structure, a method has been proposed in which the heat from the electric heater is transferred to the melt spinning head structure through heat-transfer cement. By this method, however, it is not possible to obtain a stable performance over a long period of time because of cracks or the like in the heat-transfer cement. In addition, its heat losses are large.

Another method has been employed in which a heater cast in an aluminum-base alloy is wound directly around the melt spinning head structure to increase the thermal efficiency. This method, however, has the disadvantage that the size of the electric heater itself is increased to make the melt spinning head structure larger in size and weight, so that it is difficult to maintain and operate the melt spinning head structure, and its electric power consumption increases.

In melt spinning, particularly in high-temperature melt spinning such as the spinning of pitch carbon fibers, a method is generally employed in which a special heat transfer medium, e.g., a high-boiling point organic matter such as Dowtherm (the trade name of a product manufactured by Dow Chemicals of the U.S.A.), is heated by an electric heater, and the melt spinning head structure is heated by the heat transfer medium of high temperature in order to solve the nonuniformity in heating by an electric heater alone. Although this heating method is an improvement over the heating methods which use a heater alone, the high-boiling point organic heat transfer medium such as Dowtherm deteriorates considerably when used continuously for a long period of time. This deterioration produces fouling inside the apparatus, resulting in a reduction in heat conduction. Accordingly, a spinning apparatus employing a high-boiling point organic matter as a heat transfer medium requires periodic expensive and time consuming replacement of the heat transfer medium and/or cleaning of the interior of the apparatus. Another important consideration in employing this method is that the organic heat transfer medium is combustible. Any leakage thus presents a hazard of fire or explosion. Therefore, the organic heat transfer medium must be handled with extreme care, and the apparatus must be constructed to minimize risks of leakage. As a result, the spinning apparatus is complex and larger than otherwise might be required. Accordingly, the method of heating the melt spinning head structure, using a heat transfer medium constituted by such a high-boiling point organic matter, presents practical operational problems.

SUMMARY OF THE INVENTION

The inventors of the present invention have found, as the result of extensive research and experiments on apparatus and methods of heating the melt spinning head by means of heat transfer media considered to be most suitable for melt spinning at present, that fusible alloys have excellent properties as heat transfer media, that is, fusible alloys have a better heat efficiency than the high-boiling point organic heat transfer media which are conventionally employed, and will not deteriorate nor produce fouling within the apparatus even if they are used for a long period of time, and are not hazardous to handle.

Accordingly, it is a primary object of the invention to provide apparatus and method of heating a melt spinning head structure suitable for high-temperature melt spinning, particularly for the spinning of pitch into multifilaments of 500 to 1000 filaments.

It is another object of the invention to provide apparatus and method of heating a melt spinning head structure which will not cause any deterioration or fouling within the apparatus, even during extended use, and which permits stable heating.

It is still another object of the invention to provide apparatus and method of heating a melt spinning head structure which can be realized with a simple structure.

A preferred embodiment for carrying out the present invention involves the use of a fusible alloy inserted or injected into a heater jacket formed in a nozzle head and/or a mandrel of a melt spinning head structure. The fusible alloy efficiently conducts the heat from the heater to the melt spinning head structure. Another embodiment of the invention involves directly heating an alloy-melting not formed in, for example, a nozzle head of a melt spinning head structure or provided in another portion, by means of a heater or a furnace; and recirculating molten fusible alloy to the melt spinning head structure. In this case, heat preservation by means of an enveloping steam or a sheath heater may be effected.

The fusible alloy of this invention is a low-melting point alloy which has the eutectic composition of an alloy constituted by two or more of elements such as Bi, Pb, Sn, Cd, In, Zn, Sb, Hg, etc., or has a composition close to the eutectic alloy composition. Fusible alloys which are preferably employed by the present invention are those which have a small volumetric expansion on solidification, and which melt a temperature between about 50° C. and about 200° C.; therefore, preferable fusible alloys have binary to quaternary eutectic compositions, such as Bi-Sn, Pb-Sn, Bi-Pb-Sn, Pb-Sn-Cd, Bi-Pb-Sn-In alloys.

DESCRIPTION OF THE PREFERRED EMBODIMENTS

The following is the description of an apparatus for carrying out the heating method in accordance with the invention.

Figure 1:
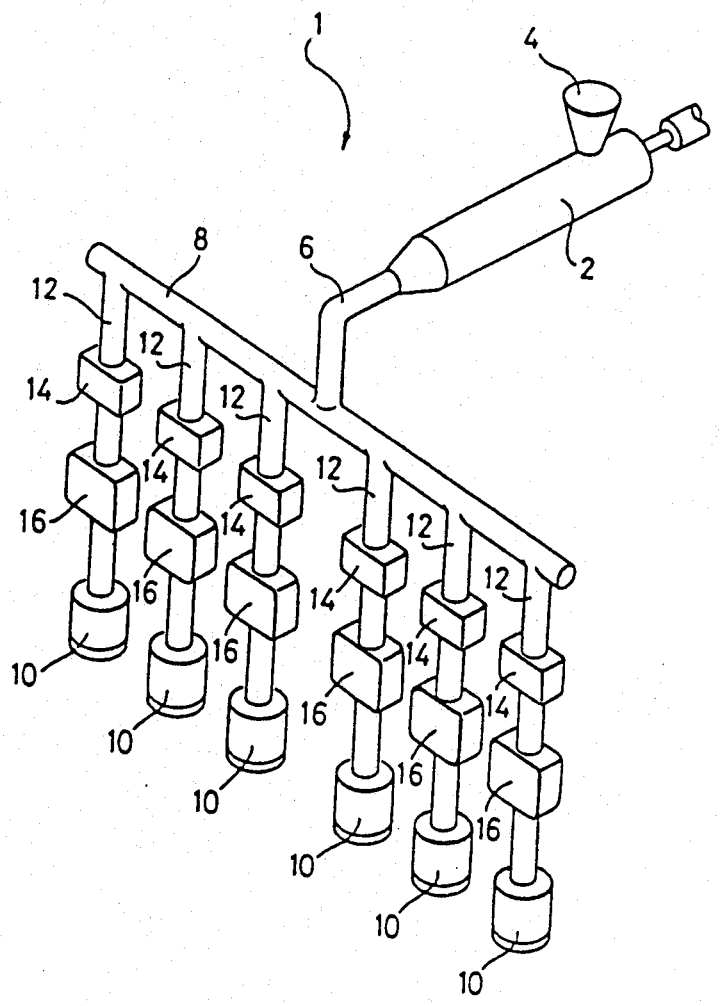
FIG. 1 is a schematic perspective view of a melt spinning apparatus.

FIG. 1 schematically illustrates a melt spinning apparatus 1 for melt spinning petroleum pitch carbon fibers in general. The melt spinning apparatus 1 has an extruder 2 which receives and melts a material to be spun such as petroleum pitch. The extruder 2 melts the spinning material charged from an inlet 4, and extrudes the molten spinning material to a header pipe 8 through a discharge pipe 6. The header pipe 8 communicates with a number of melt spinning head structures 10 (six in the case of FIG. 1) through corresponding connection pipes 12. Between the header pipe 8 and the melt spinning head structures 10, it is preferable to provide the material feed control valves 14 and the gear pumps 16 which can supply the molten spinning material to the corresponding melt spinning head structures 10 at a predetermined pressure and feed rate. These gear pumps 16 are each driven by driving devices (not shown).

The extruder 2, the discharge pipe 6, the header pipe 8, the connection pipes 12, the control valves 14, the gear pumps 16, etc., are each adapted to incorporate their own heaters thereon or therein so that they can be directly heated, thereby enabling the spinning material to be maintained in the molten state.

An embodiment of the melt spinning head structure 10 will be described hereinunder with reference to FIG. 2. The melt spinning head structure 10 usually has a body member referred to as nozzle head or die 20 defining the outer housing of the melt spinning head structure 10, and a spinneret plate 24 attached to the nozzle head 20 by a spinneret plate holder 22. The spinneret plate holder 22 is secured to the nozzle head 20 by bolts (not shown). The nozzle head 20 has therein a passage 28 for supplying the molten spinning material through the connection pipe 12 to nozzles 26 formed in the spinneret plate 24. The material feed passage 28 can be defined by a chamber 30 formed in the nozzle head 20 and a mandrel 32 positioned within the chamber. In this embodiment, the mandrel 32, formed in a substantially conical shape, is secured to the spinneret plate 24 by bolts (not shown). Since the arrangement of the nozzles formed in the spinneret plate 24 varies according to the kind of fiber being spun, the shape of the mandrel 32 will vary correspondingly. In addition, the mandrel 32 is not necessary.

Figure 2:
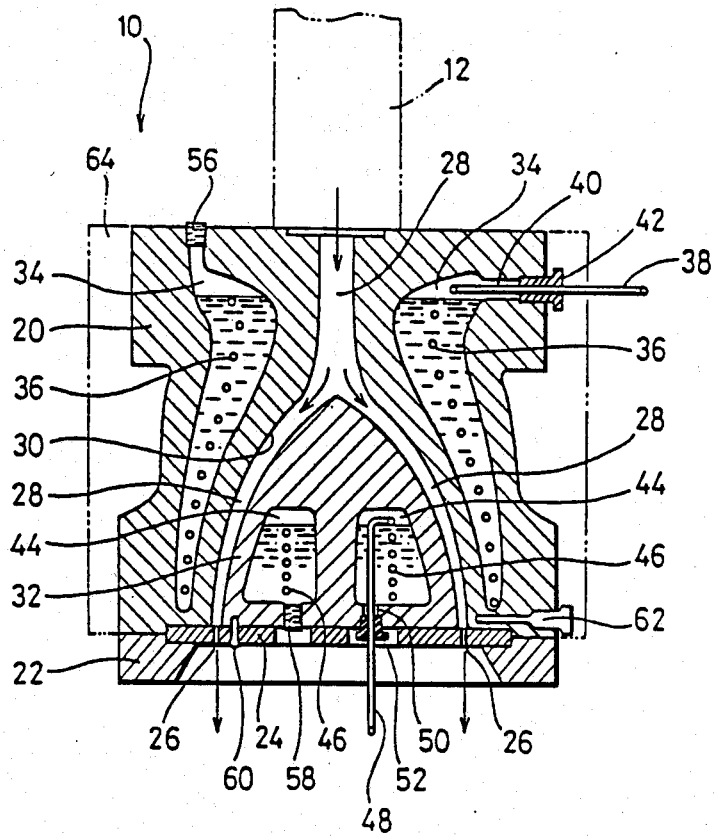
FIG. 2 is a schematic section through a melt spinning head structure of the present invention.

As will be understood from FIG. 2, the interior of the nozzle head 20 is provided with a heating chamber 34 which virtually surrounds the passage 28. A sheath heater (insulator-covered electric heater) 36 is provided within the chamber 34. The sheath heater 36 is arranged so as to extend through the heating chamber 34 and surround the passage 28. Lead wires 38 for the heater are led out through an opening in a plug 42 fitted in a guide hole 40 which is bored in the nozzle head 20 and communicates with the heating chamber 34, and are connected to an electric power source (not shown).

In this embodiment, the interior of the mandrel 32 is also provided with a heating chamber 44, and a sheath heater 46 is provided within the chamber 44. Lead wires 48 for the heater 46 are led out through an opening in a plug 52 fitted in a guide hole 50 which is bored in the mandrel 32 and communicates with the heating chamber 44, and are connected to an electric power source (now shown).

Temperature-sensing controlling means 60 and 62, for controlling the current supplied to the heaters 46 and 36, respectively, to control the molten spinning material flowing through the passage 28 at predetermined temperature, are provided at appropriate positions in the mandrel 32 and the nozzle head 20, respectively.

When operating the melt spinning head structure 10 with this construction, first the temperature of the melt spinning head structure 10, including the nozzle head 20 and the mandrel 32, is raised to between 100° C. and 200° C. by the sheath heaters 36 and 46. Then plugs 56 and 58 closing heat transfer medium inlets communicating with the heating chambers 34 and 44, respectively, are removed, and strips of fusible alloy are inserted into both the heating chambers 34 and 44, and are melted. The fusible alloy is further heated to a desired temperature by the sheath heaters 36, 46, controlled by the temperature-sensing controlling means 60, 62. Thus the molten spinning material passing through the passage 28 in the melt spinning head structure 1 is heated uniformly. This spinning material will be heated to a temperature of above 320° C. when melt spinning petroleum pitch carbon fibers.

In order to eliminate any temperature difference in the melt spinning head structure 10 itelf, to further guarantee uniform heat conduction to the molten spinning material, it is possible to provide a molded heat insulator 64 around the outer periphery of the nozzle head 20, as shown by the dot-dot-dash line in FIG. 2. It is also preferable to apply a waterproof coating to the outside of the molded heat insulator 64. The molded heat insulator 64 is preferably formed from ceramic fibers.

Figure 3:
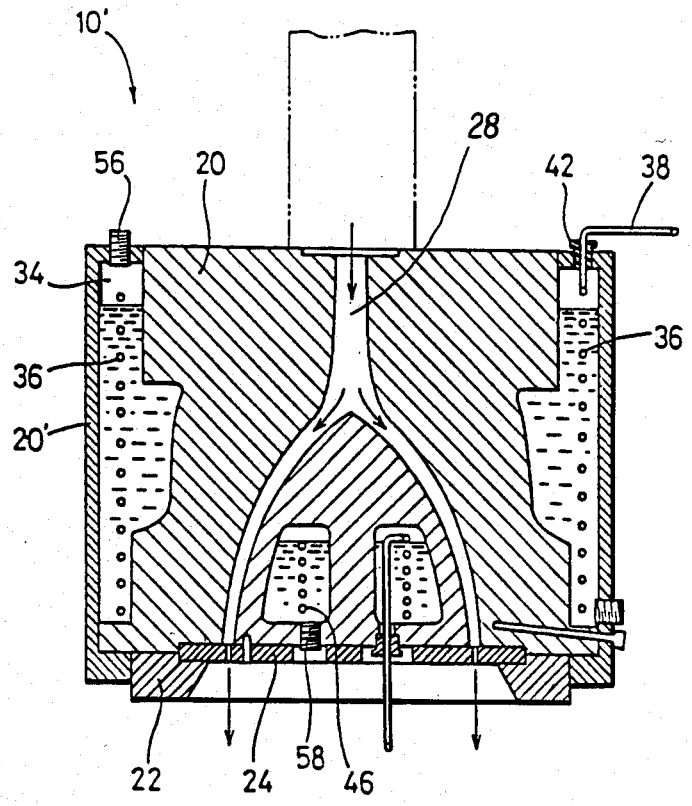
FIG. 3 is a schematic section of a melt spinning head structure in accordance with another embodiment of the present invention.

FIG. 3 shows another embodiment of the melt spinning head structure. The melt spinning head structure 10′ in accordance with this embodiment has substantially the same structure as that of the melt spinning head structure 10 of FIG. 2. The melt spinning head structure 10′ in accordance with this embodiment differs from that of FIG. 2 only in that the heating chamber 34 formed within the body of the nozzle head 20 in the melt spinning head structure 10 is defined by the nozzle head 20 and an envelope member 20′ which surrounds the outer periphery of the nozzle head 20. It is, of course, possible to provide a molded heat insulator (not shown) around the outside of the envelope member 20′, to prevent the heat dissipation from the nozzle head 20, in the same way as in the first embodiment. With the heat transfer medium inlet plugs 56, 58 removed, strips of fusible alloy are inserted and are melted by the sheath heaters 36, 46.

Although in the above description the fusible alloy pieces are held and heated in the heating chambers 34, 44, the fusible alloy pieces may be circulated between the heating chambers by employing a circulating means constituted by a fusible alloy melting pot, a furnace, a pump, etc. Moreover, an arrangement may be employed in which the fusible alloy is melted in a melting pot (now shown) provided at any portion other than the melt spinning head structure 10, 10' and is then supplied to each heating chamber by a pump and is then circulated back to the melting pot.

It is preferable that the other members of the melt spinning appartus 1 apart from the melt spinning head structures, e.g., the extruder 2, the discharge pipe 6, the header pipe 8, the connection pipes 12, the valves 14 and the gear pumps 16, should also be each provided, in a similar way to the melt spinning head structures 10, with a heating chamber, a heater or a heating means using steam, silicone oil or the like, which surrounds the heating chamber, and an outer molded heat insulator surrounding the heating chamber, to heat a fusible alloy and recirculate it if desired, to heat as well as keep the whole of the melt spinning apparatus 1 at a predetermined temperature.

Figure 4:
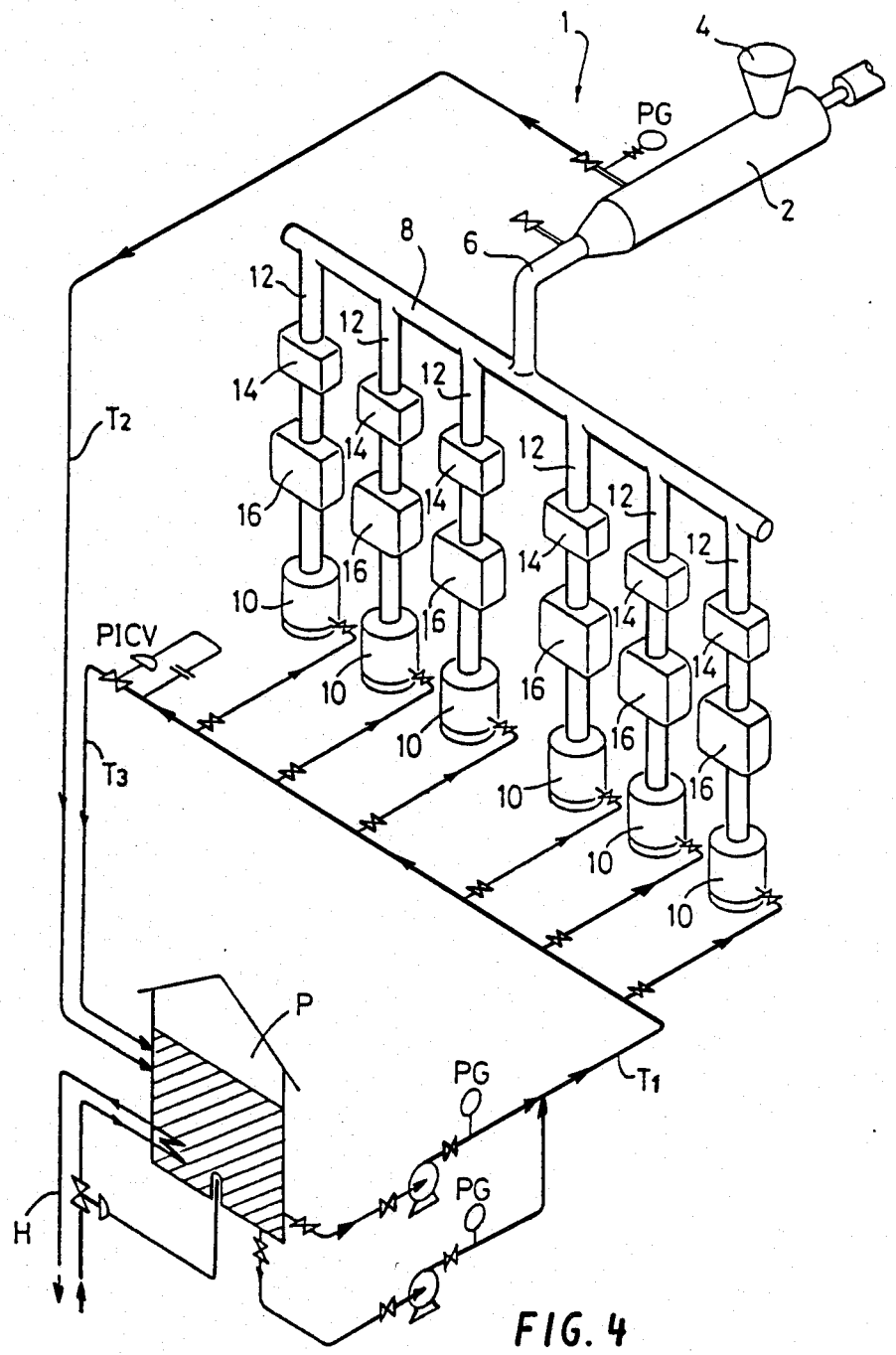
FIG. 4 is a schematic perspective view of still another embodiment of the melt spinning apparatus of the present invention.

FIG. 4 schematically illustrates still another embodiment of the melt spinning apparatus in accordance with the present invention, in which the fusible alloy is thus circulated. A fusible alloy melting pot P is heated by a heating circuit H constituted by an electric heater or by steam. The molten alloy in the melting pot P is supplied to the melt spinning head structures 10 by pumps PG and the tube $T_1$. Then the molten alloy is supplied by suitable conduits or jackets to each of the gear pumps 16, the control valves 14, the connection pipes 12, the header pipe 8, the discharge pipe 6, and the extruder 2 and is returned to the melting pot P by a tube $T_2$. A tube $T_3$ is a by-pass line for safety.

The fusible alloy can be selected from binary, ternary and quaternary eutectic alloys, such as Bi-Sn, Pb-Sn, Bi-Pb,Sn, Pb-Sn-Cd, Bi-Pb-Sn-In alloys. It is, however, advantageous from an operating point of view to employ an alloy with a low melting point of 58° C. [Bi(49%), Pb(18%), Sn(12%), In(21%)] in a circulating system in which the alloy is recycled is a heat transfer medium by a pump or the like. Although another alloy with a melting point of 170° C. [Bi(40%), Sn(60%)] has a lower cost than the alloy with the melting point of 58° C., the equipment for preheating the apparatus in which such an alloy is employed has a higher cost. In the injection system described with reference to FIG. 2, different from the circulating system, an alloy such as Bi-Sn, Pb-Sn-Cd or Bi-Pb-Sn has a low cost and is excellent for this heating method. In addition, it is preferable to employ an alloy which will not expand in volume, or else will contract, on solidification, since any volumetric expansion on solidification of the alloy in the system may damage the members constituting the apparatus.

The chemical compositions of typical fusible alloys which are preferably employed by the present invention are shown in Table 1. And Table 2 shows examples of the chemical compositions of fusible alloys which are unsuitable for the present invention.

The employment of the heating method in accordance with the present invention makes it possible to effect stable spinning over a long period of time at temperatures of above 300° C., which cannot be obtained by conventional methods. It has been found as the result of experiments that it is possible to obtain a stable performance even at temperatures of 500° C. or over, and therefore the present invention is extremely suitable for high-temperature melt spinning, particularly multifilament spinning. Moreover, the employment of a fusible alloy enables heat conductivities of about 100 to 150 times those obtained when using high-boiling point organic matter, such as Dowtherm, which is conventionally employed. In addition, there is no possibility of any deterioration due to high temperatures; hence, it is unnecessary to perform any maintenance on the heat-transfer medium. Thus, a fusible alloy has been found to be extremely good as a heat transfer medium for melt spinning. Further, a fusible alloy will never produce any fouling within the body of the object being heated, and is free from phenomena such as a reduction in heat conductivity due to extended use. Furthermore, since a fusible alloy has a high heat conductivity, as mentioned above, the invention makes it possible to construct a compact melt spinning head structure. Accordingly, it is possible to provide an energy-saving spinning apparatus which has both a low manufacturing cost and a low operating cost. In addition, if an arrangement is employed in which a heater is incorporated in the fusible alloy, when realizing the present invention, then the heat efficiency can be improved, and the life of the heater extended, so that the operation time can be lengthned.

TABLE 1

| Melting Point (°C.) | Composition (wt. %) Bi | Pb | Sn | Cd | In | Ag | Zn | Volumetric Expansion (vol.%) |
|---|---|---|---|---|---|---|---|---|
| 143 ± 6 | | 28~33 | 48~53 | 16~21 | | | | −3.2 ± 0.05 |
| 183 ± 5 | | 35~45 | 55~65 | | | | | −2.9 ± 0.05 |
| 179 ± 5 | | 35~38 | 61~64 | | | 1~2 | | −2.9 ± 0.05 |
| 165 ± 4 | 12~16 | 41~45 | 41~45 | | | | | −2.2 ± 0.04 |
| 170 ± 5 | 38~42 | | 58~62 | | | | | −0.7 ± 0.05 |
| 102 ± 4 | 52~56 | | 24~28 | 18~22 | | | | −0.2 ± 0.05 |
| 72 ± 3 | 48~52 | 23~27 | 11~14 | 10~14 | | | | −0.2 ± 0.05 |
| 58 ± 3 | 47~51 | 16~20 | 10~14 | | 19~23 | | | −0.1 ± 0.05 |
| 130 ± 4 | 54~58 | | 38~42 | | | | 3~5 | 0.00 ± 0.05 |

TABLE 2

| Melting Point (°C.) | Composition (wt. %) Bi | Pb | Sn | In | Volumetric Expansion (vol. %) |
|---|---|---|---|---|---|
| 96 | 52 | 32 | 16 | | 0.17 |
| 135 | 57 | 1 | 42 | | 0.25 |
| 109 | 68 | | | 32 | 0.99 |

What is claimed is:

1. In a melt spinning method wherein molten melt spinning material is passed through a passage formed in a nozzle head, the improvement wherein said nozzle head is maintained at the melt spinning temperature by heating a fusible alloy to a temperature above its melting point and contacting the nozzle head with the molten alloy, wherein said fusible alloy is a eutectic alloy having a melting point between 50° C. and 200° C., and having volumetric expansion below 0.05% or volumetric contraction between 0% and 3.5% on solidification, wherein the fusible alloy is a binary to quaternary eutectic composition selected from the group consisting of Pb(35–45%)-Sn(55–65%), Bi(38–42%)-Sn(58–62%), Pb(28–33%)-Sn(48–53%)-Cd(16–21%), Pb(35–38%)-Sn(61–64%)-Ag(1–2%), Bi(12–16%)-Pb(41–45%)-Sn(41–45%), Bi(52–56%)-Sn(24–28%)-Cd(18–22%), Bi(54–58%)-Sn(38–42%)-Zn(3–5%), Bi(48–52%)-Pb(23–27%)-Sn(11–14%)-Cd(10–14%) and Bi(47–51%)-Pb(16–20%)-Sn(10–14%)-In(19–23%).

2. The method as defined in claim 1 wherein the nozzle head is heated by heating the alloy with a heater incorporated in said fusible alloy.

3. The method as defined in claim 1 wherein the nozzle head is heated by heating the alloy externally of the head and circulating the molten alloy through a chamber formed in said nozzle head in surrounding relationship to said passage.

4. The method as defined in claim 1 wherein the melt spinning material is petroleum pitch and the spinning temperature is above 300° C.

5. A melt spinning head structure comprising a body member having a passage formed therein for conducting molten spinning material therethrough and a heating chamber formed therein and arranged in surrounding relationship to said passage; and a spinneret plate having a plurality of spinneret nozzles formed therein and being in fluid communication with said passage, the improvement wherein said heating chamber contains a low melting point fusible alloy and wherein said structure comprises means for heating the alloy to the melt spinning temperature, said alloy being molten at said melt spinning temperature, wherein said fusible alloy is a eutectic alloy having a melting point between 50° C. and 200° C., and having volumetric expansion below 0.05% or volumetric contraction between 0% and 3.5% on solidification, wherein the fusible alloy is a binary to quaternary eutectic composition selected from the group consisting of Pb(35–45%)-Sn(55–65%), Bi(38–42%)-Sn(58–62%), Pb(28–33%)-Sn(48–53%)-Cd(16–21%), Pb(25–38%)-Sn(61–64%)-Ag(1–2%), Bi(12–16%)-Pb(41–45%)-Sn(41–45%), Bi(52–56%)-Sn(24–28%)-Cd(18–22%), Bi(54–58%)-Sn(38–42%)-Zn(3–5%), Bi(48–52%)-Pb(23–27%)-Sn(11–14%)-Cd(10–14%) and Bi(47–51%)-Pb(16–20%)-Sn(10–14%)-In(19–23%).

6. The apparatus of claim 1 wherein the means for heating the alloy includes a heater incorporated in said fusible alloy.

7. The apparatus of claim 1 wherein the means for heating the alloy includes a heater positioned externally of said body member for heating the alloy and means for circulating the heated alloy through said chamber.

8. In a melt spinning apparatus which includes a extruder, a gear pump, and nozzle head, the improvement for heating such apparatus comprising a heater for heating a fusible alloy to a temperature above the alloy's melting point, and means for circulating the molten alloy in contact with the nozzle head, and at least one other component of the apparatus, wherein said fusible alloy is a eutectic alloy having a melting point between 50° C. and 200° C., and having volumetric expansion below 0.05% or volumetric contraction between 0% and 3.5% on solidification, wherein the fusible alloy is a binary to quaternary eutectic composition selected from the group consisting of Pb(35–45%)-Sn(55–65%), Bi(38–42%)-Sn(58–62%), Pb(28–33%)-Sn(48–53%)-Cd(16–21%), Pb(35–38%)-Sn(61–64%)-Ag(1–2%), Bi(12–16%)-Pb(41–45%)-Sn(41–45%), Bi(52–56%)-Sn(24–28%)-Cd(18–22%), Bi(54–58%)-Sn(38–42%)-Zn(3–5%), Bi(48–52%)-Pb(23–27%)-Sn(11–14%)-Cd(10–14%) and Bi(47–51%)-Pb(16–20%)-Sn(10–14%)-In(19–23%).

* * * * *